US009222349B2

(12) United States Patent
LeBlanc

(10) Patent No.: US 9,222,349 B2
(45) Date of Patent: Dec. 29, 2015

(54) CEMENTING PLUG TRACKING USING DISTRIBUTED STRAIN SENSING

(75) Inventor: Michel Joseph LeBlanc, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 693 days.

(21) Appl. No.: 13/562,456

(22) Filed: Jul. 31, 2012

(65) Prior Publication Data

US 2014/0034301 A1 Feb. 6, 2014

(51) Int. Cl.
*E21B 33/16* (2006.01)
*E21B 47/00* (2012.01)
*E21B 47/09* (2012.01)

(52) U.S. Cl.
CPC ..... *E21B 47/0005* (2013.01); *E21B 33/16* (2013.01); *E21B 47/09* (2013.01)

(58) Field of Classification Search
CPC ..... E21B 47/00; E21B 47/09; E21B 47/10; E21B 47/0005; E21B 33/00; E21B 33/05; E21B 33/12; E21B 33/124; E21B 33/13; E21B 33/14; E21B 33/16; E21B 23/14
USPC ..... 340/854.1
See application file for complete search history.

(56) References Cited

U.S. PATENT DOCUMENTS 1,369,891 A * 3/1921 Halliburton ..... 166/253.1
2,253,537 A * 8/1941 Searamucci ..... 166/64
2,275,473 A * 3/1942 Scaramucci ..... E21B 33/16 200/83 R
4,093,028 A * 6/1978 Brandon ..... B06B 3/00 166/281
5,437,330 A * 8/1995 Gambertoglio ..... E21B 33/16 166/154
6,196,311 B1 * 3/2001 Treece ..... E21B 33/05 166/192
6,561,488 B1 * 5/2003 Walker ..... H02G 1/086 15/104.061
6,747,743 B2 6/2004 LeBlanc
6,957,576 B2 10/2005 Skinner et al.
8,517,096 B2 * 8/2013 Vigneaux ..... E21B 47/102 166/253.1
2002/0157828 A1 * 10/2002 King et al. ..... 166/285
2004/0060697 A1 * 4/2004 Tilton ..... E21B 33/16 166/253.1
2009/0219171 A1 * 9/2009 Vigneaux ..... E21B 33/16 340/854.1
2011/0170112 A1 7/2011 LeBlanc
2012/0085531 A1 * 4/2012 Leising et al. ..... 166/77.2

OTHER PUBLICATIONS

Halliburton Energy Services, Inc, "Cementing Wiper Plugs", 2009 Halliburton, 10 pgs.

* cited by examiner

*Primary Examiner* — David Andrews
*Assistant Examiner* — Carib Oquendo
(74) *Attorney, Agent, or Firm* — Krueger Iselin LLP; Scott H. Brown

(57) ABSTRACT

Various systems and methods for cementing plug tracking using distributed strain sensing include a downhole cementing apparatus that includes a distributed strain sensor with an optical cable and a first downhole cementing plug coupled to a fixed point on the optical cable. The apparatus further includes a second downhole cementing plug slidably coupled to the optical cable between the first downhole cementing plug and a sensing end of the optical cable. The second downhole cementing plug causes a detectable feature in a strain profile along the optical cable's length that indicates a position of the second downhole cementing plug.

20 Claims, 4 Drawing Sheets

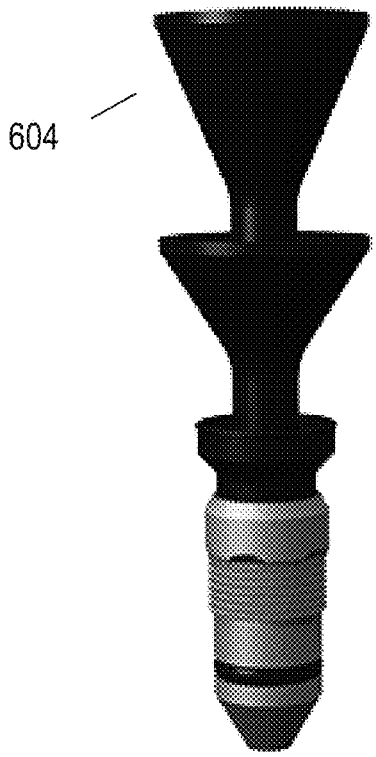
FIG. 6
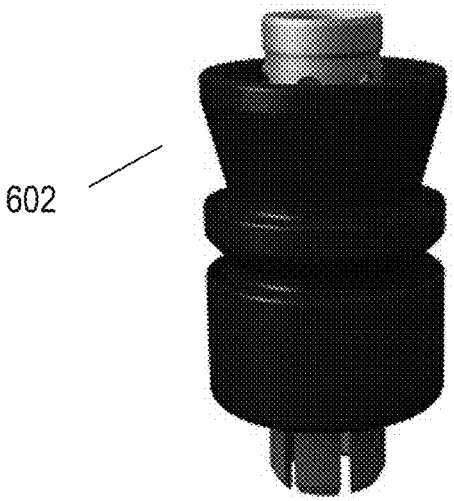

CEMENTING PLUG TRACKING USING DISTRIBUTED STRAIN SENSING

BACKGROUND

As wells are drilled to greater lengths and depths, it becomes necessary to provide a liner ("casing") to avoid undesirable fluid inflows or outflows and to prevent borehole collapse. The annular space between the borehole wall and the liner is usually filled with cement (a process referred to as "cementing" the well) to reinforce structural integrity and to prevent fluid flows along the outside of the liner. If such fluid flows are not prevented, there is a loss of zonal isolation. Fluids from high-pressured formations can enter the borehole and travel along the outside of the casing to invade lower-pressured formations, or possibly exit the borehole in a mixture that dilutes the desired production fluid. Results may include contamination of aquifers, damage to the hydrocarbon reservoir, and loss of well profitability.

When cementing a well, the cement is generally injected down the interior of the casing to the bottom of the borehole and forced back upward around the casing. Tools referred to as cementing plugs are sometimes used to separate the cement from spacer fluids injected into the well. Spacer fluids are fluids used to separate and thus reduce contact and mixing between wellbore fluids (e.g., drilling fluid and cement). A lower plug is first inserted into the casing ahead of the cement to separate the cement from spacer fluid already injected into the well. Cement is then pumped into the casing behind the lower plug, which drives the lower plug down into the well. This forces fluid already in the borehole (e.g., spacer and drilling fluid) back up into the annular region between the casing and the formation and to the surface where it is safely collected.

Once the desired amount of cement has been injected into the casing, an upper plug is inserted into the casing, and spacer fluid is injected above the upper plug. The upper plug separates the spacer fluid from the cement, and the two plugs and the cement in between move downward as fluid is injected above the upper plug. As it moves downward, the lower plug wipes fluid and other materials from the inner surface of the casing in front of the cement, thus helping to reduce contamination of the cement. When the lower plug is stopped by a float collar near the bottom of the casing, pressure is increased until a diaphragm in the lower plug ruptures, allowing the cement to flow past the lower plug and float collar, into the bottom of the borehole and back up the annular region outside the casing. Although this puts the cement in contact with the spacer fluid on the other side of the lower plug, the formulation of the spacer fluid reduces the degree to which it mixes with and adversely affects the cement. The upper plug continues to be forced downward by the spacer fluid above it until the cement is forced out from between the two plugs and the upper plug lands on the lower plug. The cement is then left to cure before any further drilling or production activities continue.

As cementing proceeds, it is useful to know the position of each plug as it progresses down the casing in order to track the position of the cement itself. Many existing techniques rely on pressure variations in the fluid to identify the position of the plugs at a few key points during cementing, such as the pressure increase that occurs when the first plug arrives at the float collar. But such pressure variations are generally small enough to be easily missed on the surface (just a few hundred pounds per square inch). Further, other events such as a stuck lower plug may also cause similar pressure increases that may incorrectly be interpreted as a plug reaching a key position.

Existing techniques also do not track the distance between the upper and lower plugs (and thus the volume of cement between the plugs) as the plugs and cement travel through the casing. Changes in the cement volume can be indicative of a problem such as significant contamination of the cement. Such contamination can compromise the integrity of the cement, as well as the overall long-term safety of the well and those working around it.

BRIEF DESCRIPTION OF THE DRAWINGS

A better understanding of the various disclosed embodiments can be obtained when the following detailed description is considered in conjunction with the attached drawings, in which:

FIG. 6 shows an illustrative outer ring and inner dart.

It should be understood that the drawings and corresponding detailed description do not limit the disclosure, but on the contrary, they provide the foundation for understanding all modifications, equivalents, and alternatives falling within the scope of the claims.

DETAILED DESCRIPTION

The paragraphs that follow describe illustrative cementing plug tracking systems and methods using distributed strain sensing. An overview of an illustrative borehole cementing operation that incorporates the described embodiments is first described, followed by a description of suitable cementing plugs and optical cables. Operation of an illustrative embodiment is subsequently described, together with an illustrative method used to operate the embodiment described.

Figures 1, 2:
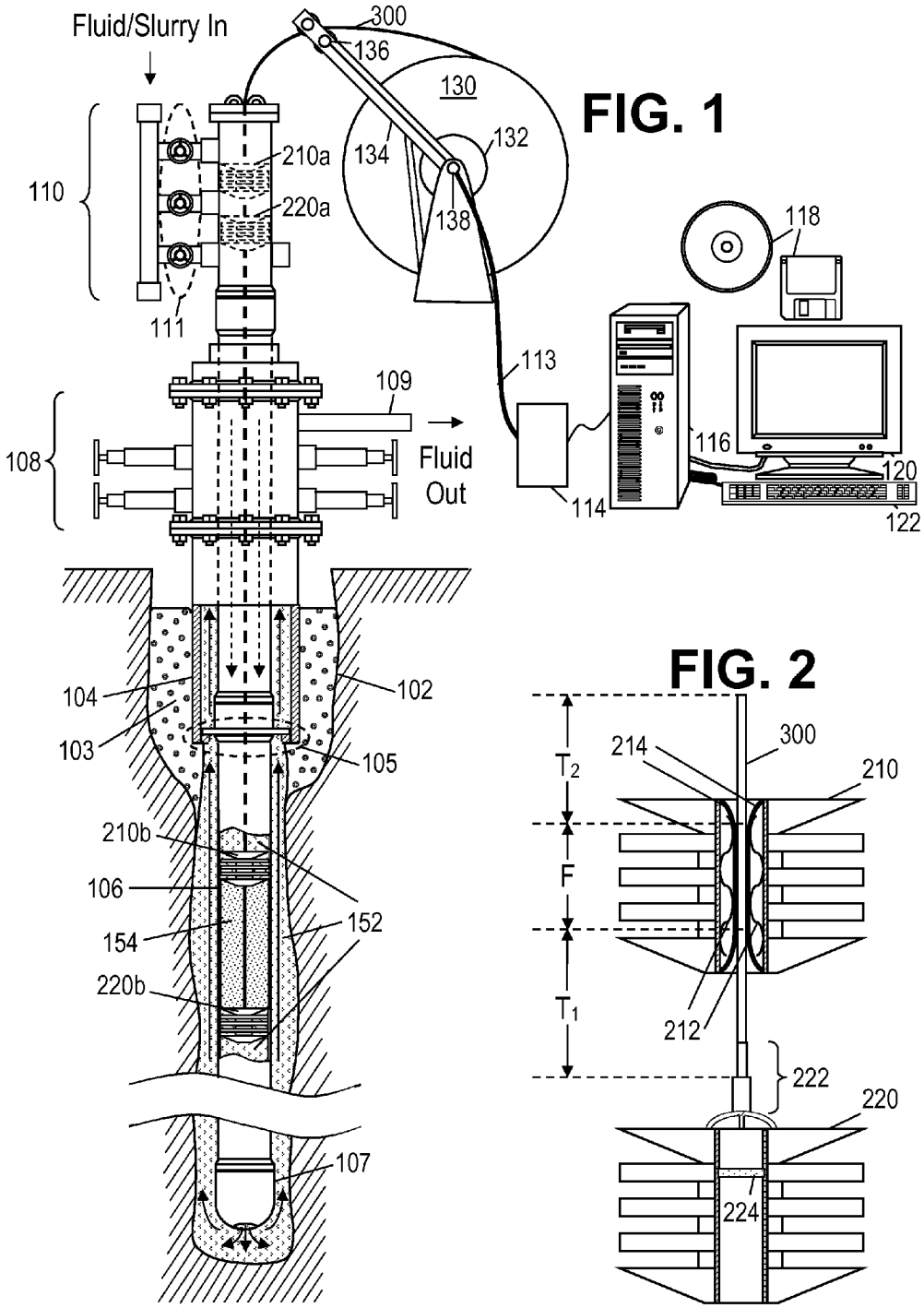
FIG. 1 shows an illustrative borehole cementing operation with plug tracking.
FIG. 2 shows illustrative upper and lower plugs coupled to an optical cable.

FIG. 1 shows an illustrative borehole 102 that has been drilled into the earth. Such boreholes are routinely drilled to ten thousand feet or more in depth and can be steered horizontally for perhaps twice that distance. The borehole shown is configured for cementing operations, which as previously noted secures the casing within the borehole. Casing header 104, secured into place before the start of drilling operations by cement 103, provides the anchor point for the other components, including casing 106, blowout preventer (BOP) 108 and cementing head 110. Cementing head 110 couples to the top of casing 106, which passes through BOP 108 and is coupled to casing header 104 by casing hanger 105. Casing hanger 105 includes orifices that permit the passage of fluids. Fluids circulated through the borehole, including the cement slurry used to cement the casing into place, are injected into cementing head 110, down through casing 106 and cementing shoe 107 (coupled to the downhole end of casing 106), back up borehole 102 through the annulus between the exterior of casing 106 and the borehole wall, and out return line 109 of BOP 108.

Prior to initiating cementing operations, cementing plugs (shown in FIG. 1 in their pre-deployment configuration as upper cementing plug 210*a* and lower cementing plug 220*a*) are initially positioned relative to valves 111 of cementing head 110 so as to allow fluids to be directed ahead or behind each of the plugs. In the example shown, lower cementing plug 220*a* is positioned between lower and middle valves 111, and upper cementing plug 210*a* is positioned between upper and middle valves 111. Before the cementing plugs are deployed, lower valve 111 is opened and fluid is injected and circulated through borehole 102 to clear out residual cuttings and other debris. While drilling fluid may initially be used to clear the residual material, spacer fluid 152 is injected to either side of the cementing plugs to reduce any adverse effect that may be caused by mixing of spacer fluid 152 with the cement slurry.

Once debris has been cleared by the circulating fluid and spacer fluid has been injected in front of lower cementing plug 220*a*, lower valve 111 is closed and the flow of spacer fluid is shut off. Middle valve 111 is then opened, lower cementing plug is configured for deployment (e.g., any locking pins are removed) and cement slurry is injected into cementing head 110, pushing lower cementing plug 220*a* downhole through casing 106. The downhole movement of lower cementing plug 220*a* also triggers the deployment of optical cable 300, which is coupled to lower cementing plug 220*a*. In the illustrative embodiment shown, the undeployed portion of optical cable 300 is coiled onto reel 130 and positioned over the borehole by deployment arm 134 as it is deployed. Counter 136 at the end of deployment arm 134 tracks the length of optical cable 300 as it is deployed. Reel 130 also includes deployment controller 132 (e.g., an electric motor and/or frictional brakes) which applies a force to reel 130 that opposes the deployment of optical cable 300 and thus maintains tension on the cable. Coupler 138 couples the sending end of optical cable 300 on the reel to interface cable 113 (e.g., via an optical slip ring), which couples to measurement unit 114. Interface cable 113, which in some embodiments includes both optical and electrical cables, also couples to counter 136 and deployment controller 132, enabling these components to be monitored and/or controlled, as applicable.

Measurement unit 114 supplies laser light pulses to the cable(s) and analyzes the returned signal(s) to perform distributed sensing of one or more parameters along the length of optical cable 300, including strain and temperature. Optical cables that are specially configured to sense these parameters and suitable for use in harsh environments are commercially available. The light pulses from measurement unit 114 pass through the fiber and encounter one or more parameter-dependent phenomena. Such phenomena include Brillouin and Raman backscattering of light. Typical silica-based optical fibers are sensitive to density changes which, for appropriately configured fibers, are indicative of strain, temperature or other parameters that vary in response to environmental conditions. Such variations will modulate the inelastic scattering of photons within the fiber (such as Raman or Brillouin scattering), giving detectable variations in the backscattered light.

To collect the measurements, measurement unit 114 may feed tens of thousands of laser pulses each second into the optical fiber and apply time gating to the reflected signals to collect parameter measurements at different points along the length of optical cable 300. The measurement unit can process each measurement and combine it with other measurements for that point to obtain a high-resolution measurement of that parameter. A general purpose data processing system 116 can periodically retrieve the measurements as a function of position and establish a time record of those measurements. Software (represented by information storage media 118) runs on the general purpose data processing system to collect the measurement data and organize it in a file or database. The software further responds to user input via a keyboard or other input mechanism 122 to display the measurement data as an image or movie on a monitor or other output mechanism 120. The software additionally monitors the deployment length of optical cable 300 and controls its tension via deployment controller 132 as the cementing plugs and the cement slurry are deployed/injected into casing 106.

After the desired amount of cement slurry has been injected, middle valve 111 is closed and the flow of cement slurry is shut off. Top valve 111 is then opened, upper cementing plug 210*a* is configured for deployment and spacer fluid is injected into cementing head 110, pushing the cementing plugs and the cement slurry downhole through casing 106. FIG. 1 shows the cementing plugs in transit through casing 106 as upper cementing plug 210*b* and lower cementing plug 220*b*. These are the same cementing plugs (210*a* and 220*a*) shown within cementing header 110, but at a different point in time after deployment. Cement slurry 154 is shown in between the two cementing plugs, as is spacer fluid 152 above upper cementing plug 210*b*, below lower cementing plug 220*b* and in in the annulus between casing 106 and the borehole wall.

Upper cementing plug 210*a* is slidably attached to optical cable 300 such that it can move along the length of the cable while still exerting a tensional force on optical cable 300. FIG. 2 shows an illustrative upper cementing plug 210 that includes one or more frictional pads 214, which are pressed against optical cable 300 by springs 212 to both seal the opening through which optical cable 300 passes and to apply a frictional force on the optical cable. This frictional force produces a strain differential along optical cable 300 between the cable segment above upper cementing plug 210 and the segment below cementing plug 210. More specifically, the tensional force along optical cable 300 between upper cementing plug 210 and reel 130 (disregarding the cumulative effect of the weight of the cable on its tension) can be expressed as:

$$T_2=T_1+F \tag{1}$$

where $T_1$ is the tensional force along optical cable 300 between the cementing plugs;

$T_2$ is the tensional force along optical cable 300 above upper cementing plug 210; and F is the frictional force applied by frictional pads 214 of upper cementing plug 210 on optical cable 300.

Continuing to refer to FIG. 2, optical cable 300 couples to lower cementing plug 220 via detachable coupler 222, which separates into two parts when a tension is applied that exceeds a release tension threshold, allowing optical cable 300 to be retrieved after the cement slurry has been deployed into its target location, as described in more detail below. Lower cementing plug 220 also includes rupture disk 224, which is ruptured to open a path for the cement slurry to pass through after lower cementing plug 220 reaches its target position.

Figure 3:
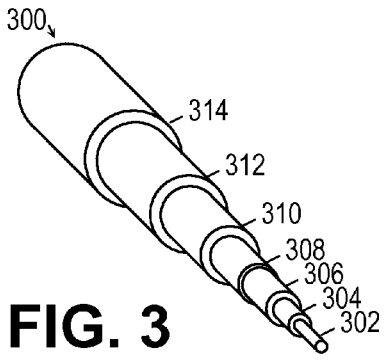
FIG. 3 shows an illustrative optical cable construction.

During the deployment of the cementing plugs, a significant amount of force is applied to the optical cable. FIG. 3 shows an illustrative optical cable 300 designed to tolerate such forces, as well as the overall hostile environment generally encountered downhole. Optical cable 300 includes one or more optical fiber cores 302 within cladding layers 304 having a higher refraction index to contain light within the core. A buffer layer 306, barrier layer 308, armor layer 310, inner jacket layer 312 and an outer jacket 314 may surround the core and cladding to provide strength and protection against damage from various downhole hazards including moisture, hydrogen (or other chemical) invasion, and the physical abuse that may be encountered in a downhole environment. Other illustrative optical cables (not shown) include additional reinforcing cables and/or jackets made from materials such as steel or Kevlar® that enable the cables to be subjected to significantly higher stresses than cables without such reinforcement.

As previously noted, time-gated reflected optical pulses received from optical cable 300 are converted to electrical signals and forwarded by measurement unit 114 of FIG. 1 for processing by software executing on processing system 116. In at least some embodiments, the software identifies the various types and patterns of backscattered laser light detected and derives a measurement of the strain present along optical fiber 300, for example, by identifying and quantifying the level of Brillouin backscattering of the light pulses. As the process of deploying the cementing plugs and injecting the various fluids and cement slurry proceeds, the overall strain profile derived from the data provided by measurement unit 114 may be used to track the positions of the cementing plugs and the cement slurry, as shown in the illustrative embodiment of FIGS. 4A through 4E and described in illustrative method 500 of FIG. 5. In at least some illustrative embodiments, the reflected light pulses are also used to confirm the length of the deployed optical cable by means of the temperature distribution along the cable, The total length of the cable interrogated remains constant but as more of the cable is deployed, a longer section is subjected to the borehole environment, which can be assessed by the temperature profile along the cable.

Figure 4A:
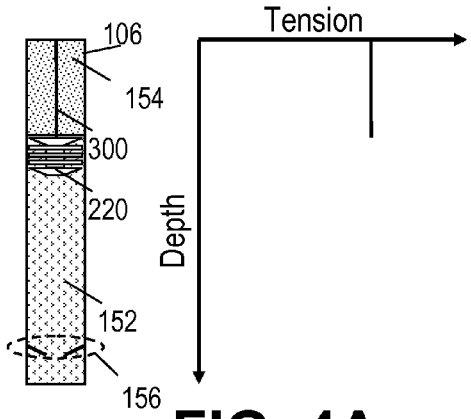
FIGS. 4A-4E show illustrative strain profiles during cementing operations.
Figure 5:
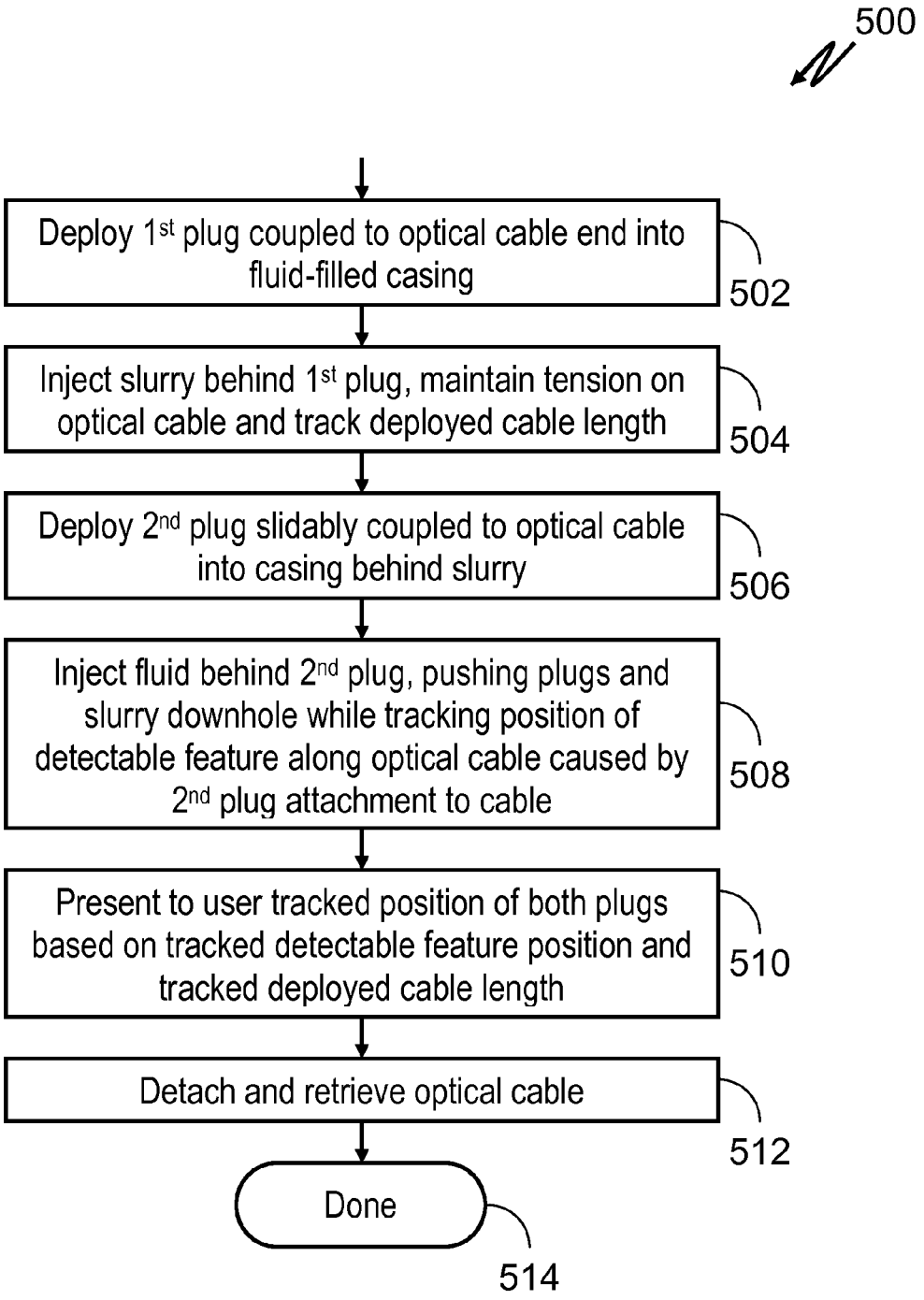
FIG. 5 shows an illustrative plug tracking method.

FIG. 4A shows a simplified casing 106 with lower cementing plug 220 deployed. Lower cementing plug 220, which is attached to the end of optical fiber 300, is deployed into casing 106 (block 502 of method 500) and forced down the casing by cement slurry 154 injected into the casing (block 504). Lower cementing plug 220 in turn pushes spacer fluid 152 down through casing 106 while also pulling optical fiber 300 down through the casing. Tension is maintained along optical cable 300 by equipment on the surface (see reel 130 and deployment controller 132 of FIG. 1), which also tracks the deployed length of optical cable 300 (block 504). The resulting strain profile is shown in the graph of FIG. 4A for this stage of the cementing operation and is relatively uniform along the length of the optical cable.

Figure 4B:
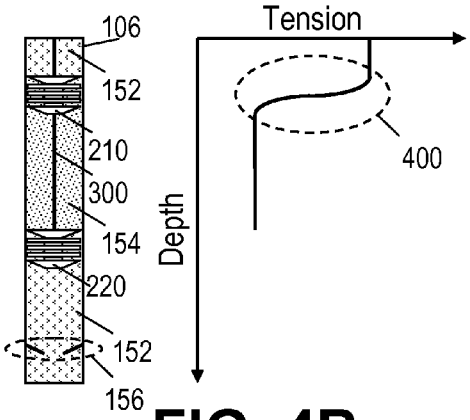

FIG. 4B shows casing 106 after the injection of cement slurry has completed, upper cementing plug 210 has been deployed (block 506) and the injection of spacer fluid 152 above the upper cementing plug has commenced (block 508). As previously noted, upper cementing plug slidably attaches to optical fiber 300, for example, using the frictional coupler illustrated in FIG. 2. At this stage of the cementing operation the injection of spacer fluid 152 above upper cementing plug 210 exerts force on the upper cementing plug, which exerts force on cement slurry 154, which in turn exerts force on lower cementing plug 220. For an illustrative embodiment that incorporates the upper cementing plug 210 shown in FIG. 2, optical cable 300, whose tension at the surface is maintained by deployment controller 132, slides upward relative to the upper cementing plug 210 until the force differential (i.e., the difference between the tension along the optical cable below the upper cementing plug and the tension along the optical cable above the upper cementing plug) equals the frictional force exerted on optical cable 300 by upper cementing plug 210. The differential in tension along the cable 300 also causes a differential in strain along the same cable, as illustrated in the graph of FIG. 4B, which shows the depth of a detectable feature 400 of the strain profile.

In above-described example, detectable feature 400 appears in the strain profile as a sharp decrease in the optical cable's tension. In other illustrative embodiments, detectable feature 400 may appear as a spike in the strain profile or in the intensity of the backscattered light (Rayleigh scattering, as measured by standard optical time-domain reflectometry). Such a spike can be induced by structures within upper cementing plug 210 that pinch optical cable 300, or that introduce deviations in the optical fiber (e.g., an s-shaped curve at or near the bend radius of optical fiber 300). Still other illustrative embodiments may locally heat the fiber within upper cementing plug 210 to produce a temperature induced detectable feature 400 (e.g., using a battery-powered heater within the upper cementing plug). Many other types of detectable features and structures within the upper cementing plug 210 for producing such detectable features will become apparent to those of ordinary skill in the art, and all such detectable features and structures are within the scope of the present disclosure.

As cementing plugs 210 and 220 move downhole so does detectable feature 400, and the position of this feature along optical cable 300 is tracked (block 508) by the software executing on processing system 116 (see FIG. 1). The position of detectable feature 400, shown in FIG. 4B as a depth within the borehole, reflects the depth of upper cementing plug 210, which together with the known length of the deployed optical cable enables the determination and tracking of the depth within the borehole of lower cementing plug 220 and thus of the start and end depths of cement slurry 154. In at least some illustrative embodiments, these positions are presented to a user of the system in real-time as the cementing operation proceeds (block 510).

The volume of the cement slurry between cementing plugs 210 and 220 may also be derived from the relative positions of the cementing plugs and tracked as the cementing plugs and the slurry move downhole. Such tracking may be used, for example, to detect an increase in the volume between the cementing plugs that may indicate an undesired incursion of the spacer fluid past the lower plug into the cement slurry. Based upon the estimated degree of contamination of the cementing slurry, a decision can be made whether to abort the cementing operation while it is still possible to do so. In at least some illustrative embodiments, attached optical cable 300 can be used to pull back lower cementing plug 220, the contaminated slurry 154 between the cementing plugs, and upper cementing plug 210. In such an embodiment, the force used to withdraw the plugs and slurry is maintained below the force needed to detach optical cable 300 from lower cementing plug 300.

Figure 4C:
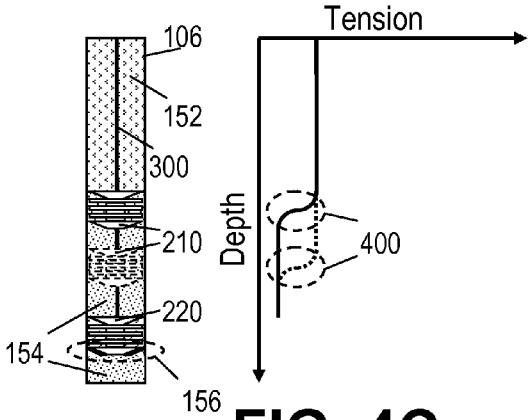

Eventually lower cementing plug 220 reaches float collar 156, which stops the lower cementing plug from moving any further down casing 106 and also causes a reduction in the tension present along optical cable 300, as shown in the strain profile graph of FIG. 4C. Once the slurry begins to flow through lower cementing plug 220 (e.g., by increasing the spacer fluid pressure behind upper cementing plug 210 until rupture disk 224 of FIG. 2 ruptures), upper cementing plug 210 begins to move relative to optical cable 300, as shown by the dashed outline of upper cementing plug 210 and of the corresponding detectable feature 400. In at least some embodiments, the detectable feature (e.g., the aforementioned strain differential) still exists and can continued to be tracked and presented to the user (blocks 508 and 510) because of the frictional force still applied to optical cable 300. It should be noted that in the embodiment shown a smaller strain differential exists at this stage of the cementing operation due to the overall reduced tension in optical cable 300 and also due to the difference between the static and dynamic coefficients of friction between the optical cable and frictional pads 214 (see FIG. 2).

Figure 4D:
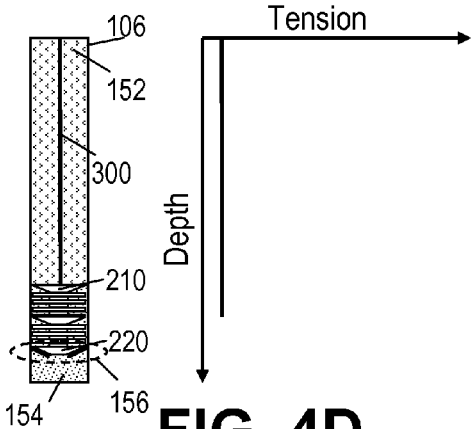
Figure 4E:
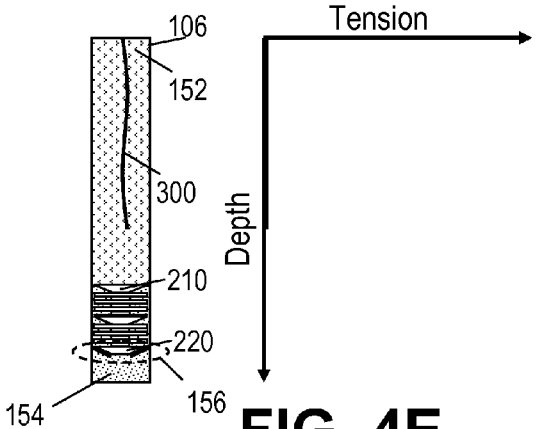

The injection of the cement slurry through lower cementing plug 220 and out the bottom of casing 106 continues as upper cementing plug travels down the casing until upper cementing plug 210 reaches and is stopped by lower cementing plug 220, as shown in FIG. 4D. At this point of the cementing operation detectable feature 400 is no longer visible and the strain profile of FIG. 4D shows a uniform tension distribution along the length of optical cable 300 (ignoring the self-loading effect of the weight of the optical cable for clarity). At this point the tension is increased beyond a release tension threshold and optical cable 300 detaches from lower cementing plug 220 (e.g., at detachable coupler 222 of FIG. 2). Note that this increase in tension can be achieved without the cementing plugs moving from their positions by maintaining fluid pressure above upper cementing plug 210. Alternatively, a clamp mechanism can be implemented in float collar 156 to lock lower cementing plug 220 in place when it reaches its landed position. Once detached as shown in FIG. 4E, optical cable 300 can be retrieved (block 512), completing the cementing operation (block 514). In still other illustrative embodiments where lower cementing plug 220 is not locked into place, a force below that required to detach optical fiber 300 from lower cementing plug 220 is applied, enabling the retrieval of both cementing plugs together with optical fiber 300.

It should be noted that it is possible to operate optical cable 300 as part of a distributed temperature sensor concurrently with the cable's operation as part of a distributed strain sensor. Software executing on computer system 116 within such an illustrative embodiment temperature compensates the tension measurements using contemporaneously sampled data that is representative of temperature measurements and that is correlated by depth to the corresponding tension measurements. The temperature compensated data may then be presented to the user. In at least some illustrative embodiments, such concurrent measurements are achieved by configuring cable 300 to include more than one optical fiber, with at least one fiber being dedicated to distributed temperature measurement using Raman scattering. In other illustrative embodiments, concurrent measurements are achieved by interrogating the same fiber using both Raman scattering (sensitive to temperature) and Brillouin scattering (sensitive to both strain and temperature).

It should also be noted that although the above embodiments are described within the context of a land-based cementing operations, other illustrative embodiments include subsea cementing operations. More specifically, at least some illustrative embodiments of the cementing plugs used in subsea cementing operations each separate into two parts, an outer ring 602 and an inner dart 604 as illustrated in FIG. 6. The outer rings are pre-loaded within the cementing head at the sea bottom and the openings within each outer ring allow fluids, pipes and tools to pass through until cementing operations commence. After spacer fluid is injected ahead of the deployment of the lower cementing plug, the lower inner dart is launched from the sea surface and forced down a pipe to the subsea wellhead by the cement slurry behind it. The lower inner dart attaches to the end of the optical cable in the same manner as shown for lower cementing plug 220 in FIG. 2, and pulls the optical cable down the pipe. When the lower inner dart reaches the lower outer ring within the wellhead, it couples to and seals against the lower outer ring to form the lower cementing plug, which continues to be forced downhole as previously described.

In at least some illustrative embodiments, the optical fiber passes through a mechanism within an upper inner dart similar to that shown within upper cementing plug 210 of FIG. 2, which is secured at the surface until the desired amount of cement slurry has been injected at the sea surface (i.e., at the rig and through the pipe leading to the subsea wellhead). The upper inner dart is then deployed behind the cement slurry in the same manner as previously described for the upper cementing plug. When the upper inner dart reaches the upper outer ring at the subsea wellhead, it couples to and seals against the upper outer ring to form the upper cementing plug, which continues to be forced downhole by the spacer fluid behind it as previously described. The reminder of the cementing operation and the tracking and presenting of the cementing plugs and cement slurry positions for this subsea embodiment are otherwise as described above.

Numerous other modifications, equivalents, and alternatives, will become apparent to those skilled in the art once the above disclosure is fully appreciated. For example, although the embodiments described incorporate frictional pads within the upper cementing plug that are always engaged, other embodiments may include mechanisms that allow the frictional pads to be engaged or disengaged (e.g., disengaged to allow the optical cable to move freely through the upper cementing plug while the lower cementing plug is being deployed). Further, although the strain differential of the above-described embodiments is created by applying a frictional force against the exterior of the optical cable, other embodiments may incorporate rollers or other similar structures that do not slide relative to the optical cable, but instead have internal frictional or other components that resist rotational or other movement, thus producing the described strain differential along the optical cable. It is intended that the following claims be interpreted to embrace all such modifications, equivalents, and alternatives where applicable.

What is claimed is:

1. A downhole cementing apparatus that comprises:

a distributed strain sensor comprising an optical cable;

a first downhole cementing plug coupled to a fixed point on the optical cable; and a second downhole cementing plug slidably coupled to the optical cable between the first downhole cementing plug and a sensing end of the optical cable, the second downhole cementing plug comprising a frictional coupler engaging in the optical cable to cause a detectable feature in a strain profile along the optical cable's length that indicates a position of the second downhole cementing plug at any location along a downhole portion of the optical cable.

2. The downhole cementing apparatus of claim 1, wherein the frictional coupler slidably couples the second downhole cementing plug to the optical cable; and wherein the detectable feature comprises a strain differential between two points along the optical cable on opposite sides of the second downhole cementing plug.

3. The downhole cementing apparatus of claim 1, further comprising a distributed temperature sensor that also comprises the optical cable.

4. The downhole cementing apparatus of claim 1, wherein the first downhole cementing plug is detachably coupled to the fixed point on the optical cable.

5. The downhole cementing apparatus of claim 1, wherein the first and second downhole cementing plugs each comprises a detachable dart that each couples its corresponding downhole cementing plug to the optical cable.

6. A downhole cementing plug tracking system that comprises:

a distributed strain sensor comprising an optical cable;

a first downhole cementing plug coupled to a fixed point on the optical cable;

a second downhole cementing plug slidably coupled to the optical cable between the first downhole cementing plug and a sensing end of the optical cable, the second downhole cementing plug comprising a frictional coupler engaging the optical cable to cause a detectable feature in a strain profile along the optical cable at any location along a downhole portion of the optical cable; and a computer system, coupled to the distributed strain sensor, that processes data representative of the strain profile;

wherein the computer system further presents to a user positions of the first and second downhole cementing plugs within a borehole based at least in part on the detectable feature's location along the optical cable.

7. The downhole cementing plug tracking system of claim 6, wherein the frictional coupler slidably couples the second downhole cementing plug to the optical cable; and wherein the detectable feature comprises a strain differential between two points along the optical cable on opposite sides of the second downhole cementing plug.

8. The downhole cementing plug tracking system of claim 6, further comprising a distributed temperature sensor that also comprises the optical cable.

9. The downhole cementing plug tracking system of claim 8, wherein the computer system further temperature compensates the strain profile based upon temperature data provided by the distributed temperature sensor.

10. The downhole cementing plug tracking system of claim 6, wherein the first downhole cementing plug is detachably coupled to the fixed point on the optical cable.

11. The downhole cementing plug tracking system of claim 6, wherein the first and second downhole cementing plugs each comprises a detachable dart that each couples its corresponding downhole cementing plug to the optical cable.

12. The downhole cementing plug tracking system of claim 6, further comprising a reel upon which an undeployed portion of the optical cable is maintained, the reel comprising a mechanism that opposes rotational movement of the reel so as to maintain tension on the optical cable as the first and second cementing plugs and the optical cable move down the borehole.

13. The downhole cementing plug tracking system of claim 6, further comprising a length tracker that tracks a length of a portion of the optical cable deployed down the borehole, wherein the computer system's presentation to the user of the first and second cementing plugs' positions is further based on the length of the deployed portion of the optical cable.

14. A downhole cementing plug tracking method that comprises:

introducing a first cementing plug, coupled to a fixed point along an optical cable, into a borehole casing at least partially filled with fluid;

injecting a cement slurry into the borehole casing behind the first cementing plug while maintaining tension on the optical cable;

introducing a second cementing plug into the borehole casing behind the cement slurry, the second cementing plug being traversed by the optical cable and slidably coupled to the optical cable, and the second cementing plug comprising a frictional coupler engaging the optical cable to cause a detectable feature in a strain profile along the optical cable at any location along a downhole portion of the optical cable;

injecting fluid behind the second cementing plug and tracking borehole positions of the first and second cementing plugs based at least in part on a tracked location of the detectable feature; and presenting to a user the tracked borehole positions of the first and second cementing plugs.

15. The downhole cementing plug tracking method of claim 14, further comprising monitoring the downhole temperature using the optical cable.

16. The downhole cementing plug tracking method of claim 15, further comprising temperature compensating the strain profile based upon data from the downhole temperature monitoring.

17. The downhole cementing plug tracking method of claim 14, further comprising:

increasing the tension on the optical cable beyond a release tension threshold and causing the release of a detachable coupling that couples the optical cable to the first downhole cementing plug; and retrieving the optical cable from the borehole.

18. The downhole cementing plug tracking method of claim 14, further comprising:

separating the first and second downhole cementing plugs respectively into a first dart and first ring and a second dart and second ring, each dart comprising a portion of the corresponding cementing plug that couples to the optical cable;

installing the first and second rings within a subsea wellhead prior to being installed at the sea bottom;

deploying the first dart down a pipe coupled to the subsea wellhead, the first dart reaching and reattaching to the first ring to form the first downhole cementing plug prior to the introducing of the first downhole cementing plug into the borehole casing; and deploying the second dart down the pipe, the second dart reaching and reattaching to the second ring to form the second downhole cementing plug prior to the introducing of the second downhole cementing plug into the borehole casing.

19. The downhole cementing plug tracking method of claim 14, further comprising:

tracking the length of the optical cable deployed down the borehole; and tracking the borehole positions of the first and second cementing plugs based further on the length of the deployed optical cable.

20. The downhole cementing plug tracking method of claim 14, further comprising retrieving the optical cable together with the first and second cementing plugs by retracting the optical cable back to the surface using a force below a release tension threshold.

* * * * *